US011009307B2

(12) United States Patent
Damarin

(10) Patent No.: US 11,009,307 B2
(45) Date of Patent: May 18, 2021

(54) HANDLE FOR FIREARM CLEANING ROD

(71) Applicant: John Damarin, Decatur, IL (US)

(72) Inventor: John Damarin, Decatur, IL (US)

( * ) Notice: Subject to any disclaimer, the term of this patent is extended or adjusted under 35 U.S.C. 154(b) by 0 days.

(21) Appl. No.: 16/229,826

(22) Filed: Dec. 21, 2018

(65) Prior Publication Data

US 2020/0200502 A1 Jun. 25, 2020

(51) Int. Cl.
*F41A 29/02* (2006.01)

(52) U.S. Cl.
CPC ..... *F41A 29/02* (2013.01)

(58) Field of Classification Search
CPC ..... F41A 29/02
USPC ..... 42/95, 108; 15/104.165
See application file for complete search history.

(56) References Cited

U.S. PATENT DOCUMENTS 486,331 A * 11/1892 Garrison ..... F41A 29/02 15/104.19
1,547,072 A * 7/1925 Thornton ..... F41A 29/02 7/165
3,208,302 A * 9/1965 Lewis ..... F41A 29/02 74/548
4,674,355 A * 6/1987 Klein ..... G05G 1/085 384/543
5,328,122 A * 7/1994 Yamaguchi ..... A01K 89/006 242/283
5,429,317 A * 7/1995 Yamaguchi ..... A01K 89/006 242/283
7,832,532 B2 * 11/2010 Nykoluk ..... A45C 13/262 16/113.1
7,836,624 B1 * 11/2010 Pennington ..... F41A 29/02 42/95
2002/0121155 A1 * 9/2002 Wu ..... B62K 3/002 74/551.7
2003/0091401 A1 * 5/2003 Thompson ..... B23G 9/009 408/221
2013/0091753 A1 * 4/2013 Rogers ..... F41A 29/02 42/95

* cited by examiner

*Primary Examiner* — Reginald S Tillman, Jr.
(74) *Attorney, Agent, or Firm* — Crump Law P.C.

(57) ABSTRACT

The handle allows attached rod sections to be selectively switched between a rotating or non-rotating attitude. The handle includes a handle body, an internal barrel coupler rotatably seating within the handle body and a lock member that engages the barrel coupler to prevent its rotation within the handle body. The rod section is attached to the barrel coupler. The locking member is manually turned either to restrictively engage the barrel coupler in a "locked" position" preventing the rotation of the barrel coupler and connected cleaning rod or to be spaced from the barrel coupler in an "unlocked" position allowing the barrel coupler and connected cleaning rod to freely rotate within the handle body.

15 Claims, 5 Drawing Sheets

HANDLE FOR FIREARM CLEANING ROD

This invention relates to cleaning tools for firearms, and in particular, a handle for a cleaning rod.

BACKGROUND AND SUMMARY OF THE INVENTION

Firearms require routine cleaning to remove discharge fouling and debris, as well as, to lubricate and preserve the barrel, breach and other components. Rigid "cleaning" rods are used to pass and draw cloth patches, swabs and brushes through the barrel bores. Conventional cleaning rods consist of a handle and one or more sections of rod that are adapted to receive various brush tips and fittings that hold the patches or swabs. Cleaning rods are also connected to the handle part for ease of use.

Heretofore, one rod section is affixed to the handle part so that the rod section is either rotating or non-rotating relative to the handle part. Often times, it is advantageous to use both rotating and non-rotating cleaning rods while cleaning and lubricating firearm barrels. The handle of this invention combines the functions of both rotating and non-rotating cleaning rods and allows attached conventional rod sections to be selectively switched between a rotating or non-rotating attitude.

The handle of this invention includes a handle body, an internal barrel coupler rotatably seated within the handle body and a lock member that can be manually turned to engage the barrel coupler to prevent its rotation within the handle body. The barrel coupler has a threaded bore for attaching conventional rod sections. The barrel coupler is rotatably disposed within a lateral bore in the handle body and held in place by a barrel retainer. The locking member includes an annular head and an elongated shaft that is turned into a threaded axial bore in the handle body. The locking member is manually turned into the handle body either to restrictively engage the barrel coupler in a "locked" position" that prevents the rotation of the barrel coupler and connected cleaning rod or to be spaced from the barrel coupler in an "unlocked" position that allows the barrel coupler and connected cleaning rod to freely rotate within the handle body. A user can manually tighten or loosen the locking member to quickly place the handle in either the locked or unlocked positions, as required for the particular application.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
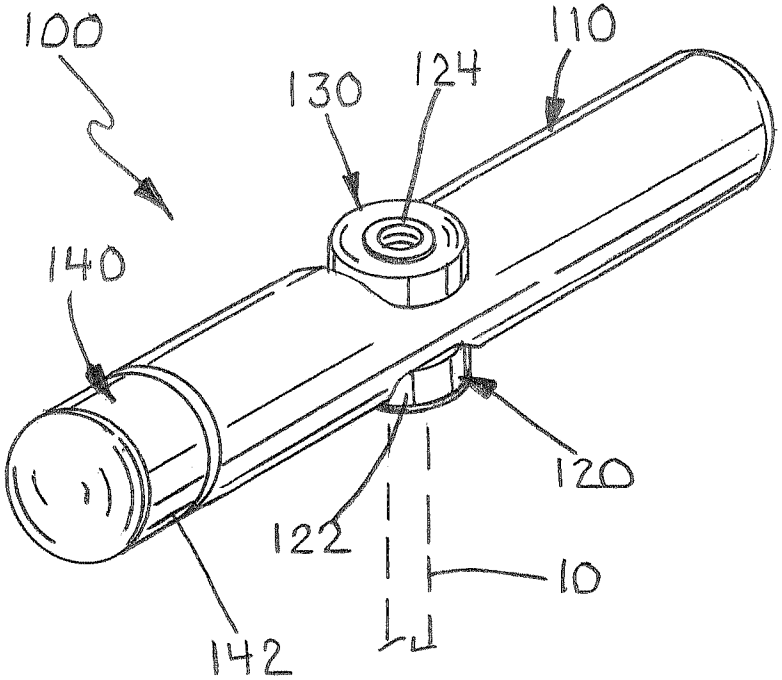
FIG. 1 is a perspective view of an exemplary embodiment of the cleaning rod handle of this invention.
Figure 2:
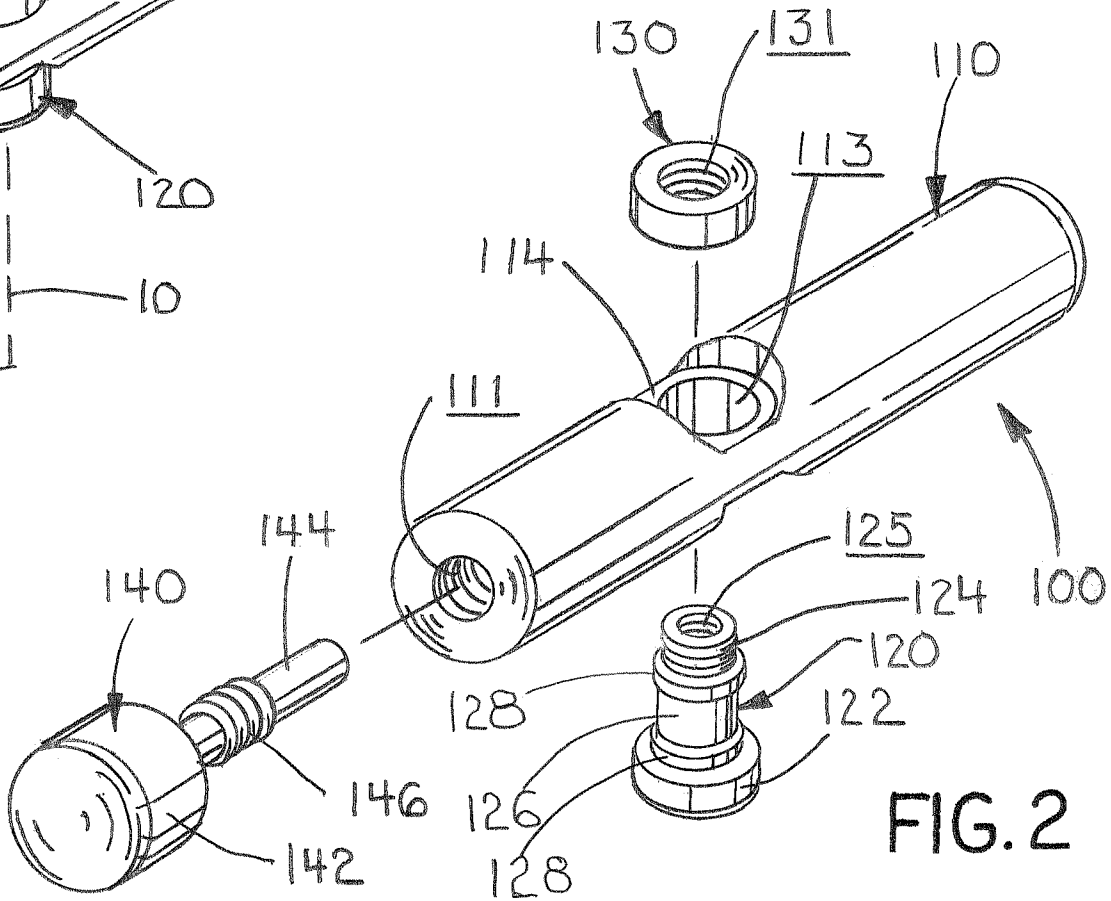
FIG. 2 is an exploded view of the cleaning rod handle of FIG. 1.
Figure 3:
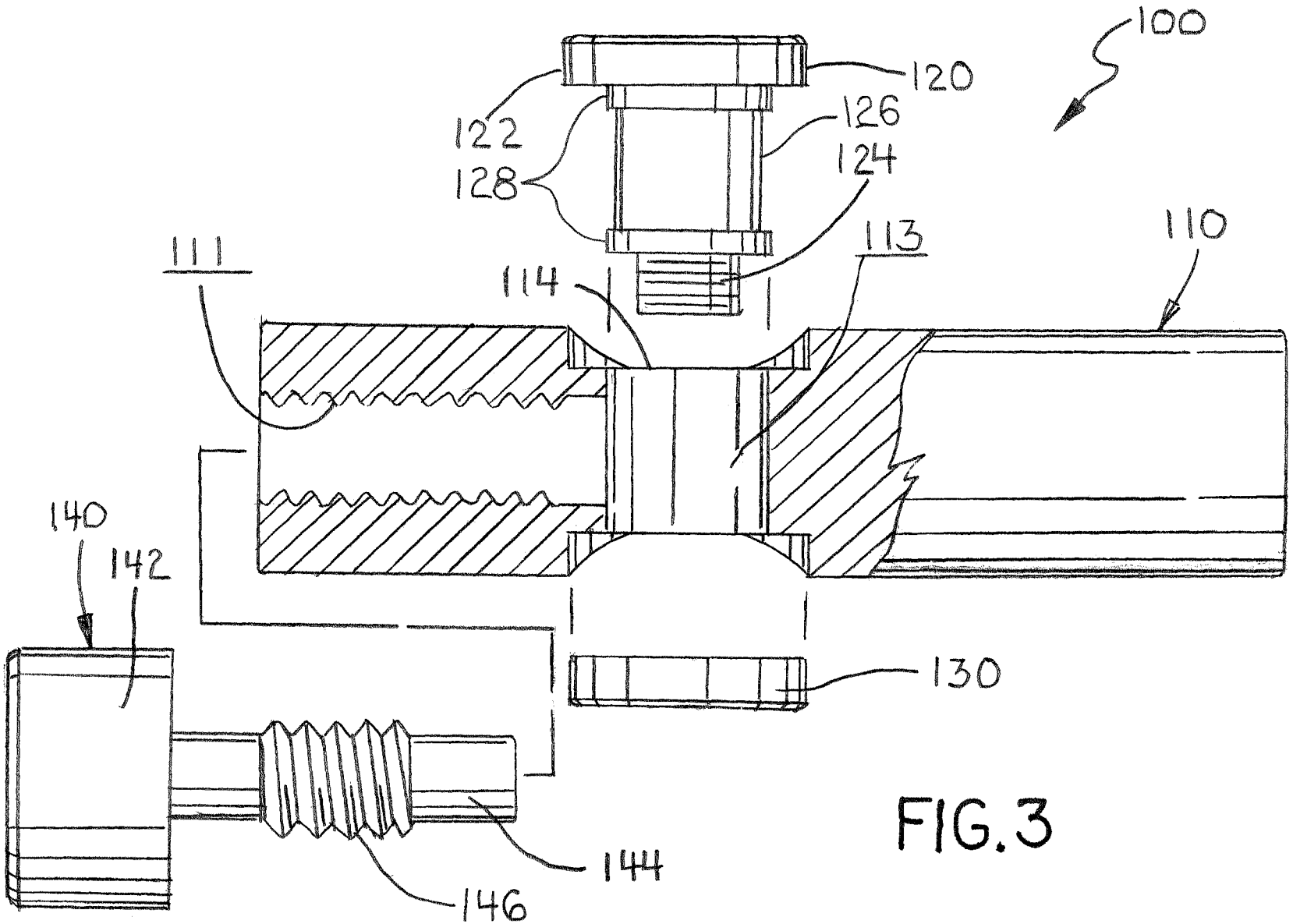
FIG. 3 is an exploded partial sectional side view of the cleaning rod handle of FIG. 1.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Referring now to the drawings, FIGS. 1-9 illustrate an exemplary embodiment of the cleaning rod handle of this invention, which is designated generally as reference numeral 100. Handle 100 is design and intended to be used with conventional cleaning rod sections. Commonly, cleaning rods have threaded male and female ends, which allow multiple sections of rods to be interconnected end to end, along with various brushes and fittings to be affixed to the ends of the cleaning rods. Similarly, handle 100 of this invention is adapted to be affixed to the threaded male end of a conventional rod section. In other embodiments, handle 100 may be used with flexible "wire" style cleaning rods, which are typically designed or intended not to twist as they pass through the firearm barrel.

Handle 100 consists of four base components: a cylindrical handle body 110, an internal barrel coupler 120, a barrel retainer 130 and a lock member 140. Each component of handle 100 is cast, formed or machined from any suitable material, however, a metal, such as brass, aluminum or steel is most desirable. Handle 100 is illustrated in a T-handle style connected to rod section 10, but other embodiments may take other forms within the teachings of this invention.

Handle body 110 is a long cylindrical piece and has an internally threaded axial bore 111 in one end and a central lateral bore 113 that extends through the body perpendicular to the handle body's longitudinal axis. Threaded axial bore 111 extends through handle body 110 into central bore 113. Handle body 110 is configured to have two recessed shoulders 114 around opposite ends of central bore 113. The exterior surface of handle body 110 may be knurled, textured or otherwise coated to allow a positive grasp of handle 100 during use.

Barrel coupler 120 is rotatably disposed within lateral bore 113 of handle 110 and held in place by barrel retainer 130. Barrel coupler 120 has a cylindrical body 126 terminating in a flat annular head 122 and an externally threaded neck 124. Barrel body 126 has a pair of raised annular flanges 128 that are is dimensioned to seated inside lateral bore 113, such that the exterior wall of the barrel body is inset from the inner wall of the lateral bore. Barrel retainer 130 is a flat disc having a thread central bore 131. Barrel retainer 130 is turned onto thread threaded neck 124 of barrel coupler 120. Barrel head 122 and barrel retainer 130 seat against recessed shoulders 114 of handle body 110 centering barrel body 126 within lateral bore 113 at the end of axial bore 111. Barrel coupler 120 has a threaded axial bore 125 for receiving the threaded end 12 of rod section 10.

Figure 4:
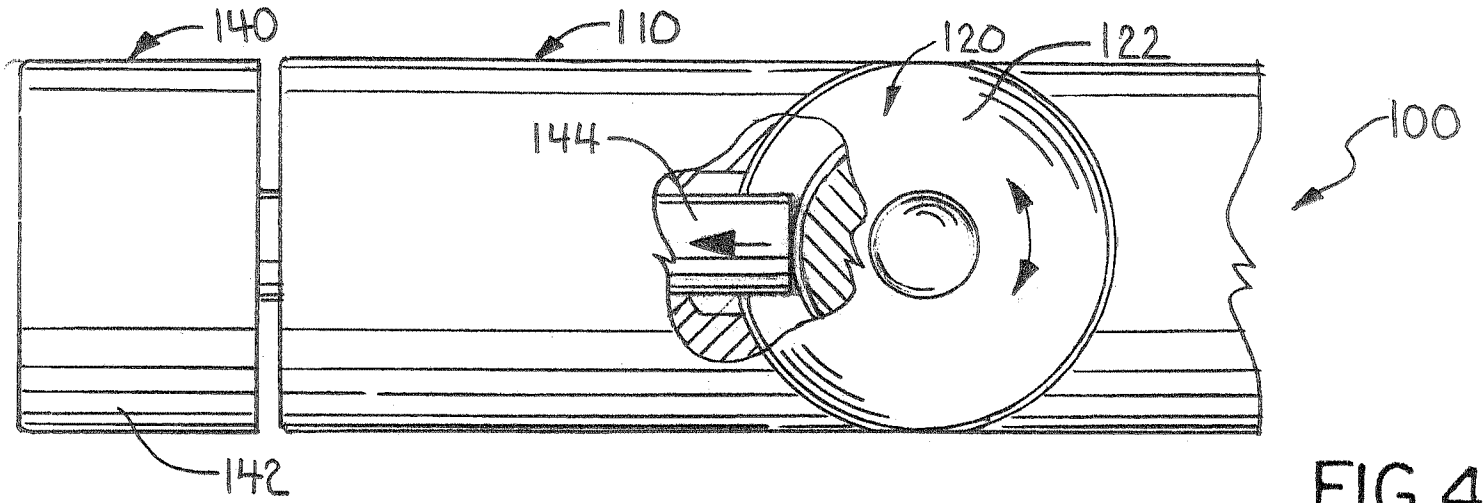
FIG. 4 is a top view of the cleaning rod handle of FIG. 1 shown in the unlocked position with portions cut away.
Figure 5:
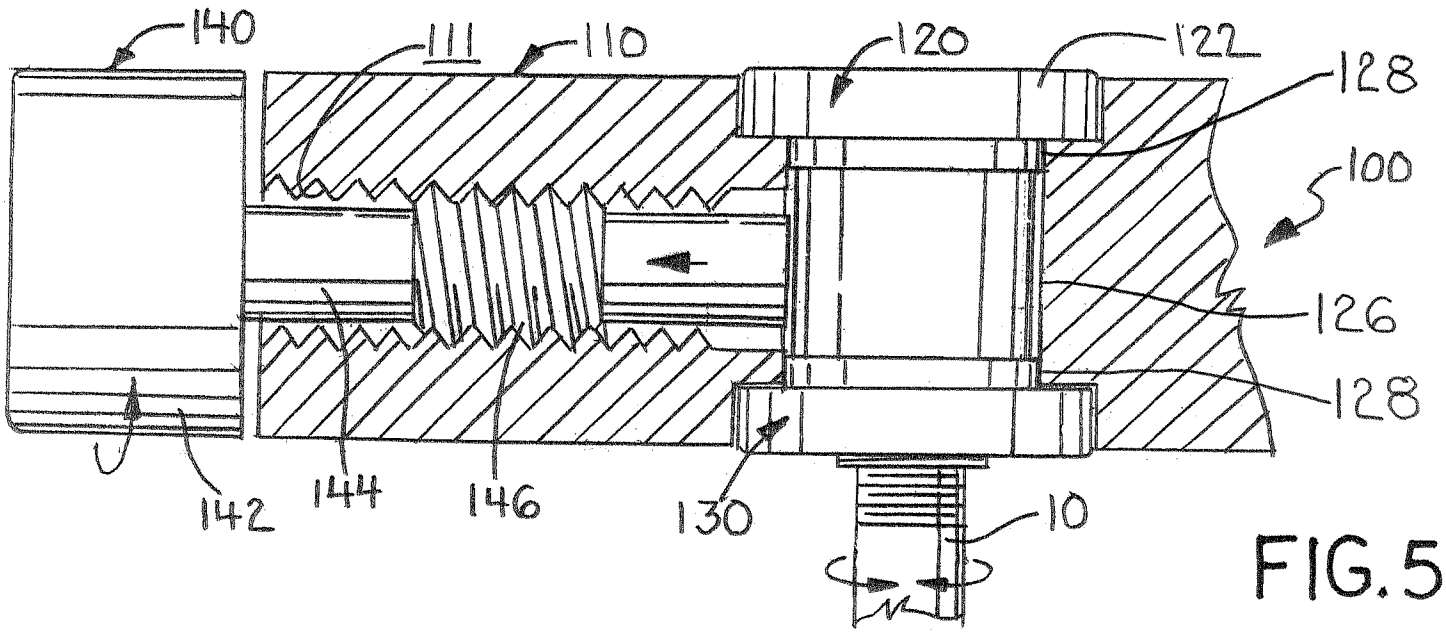
FIG. 5 is a partial side sectional view of the cleaning rod handle of FIG. 1 shown in the unlocked position.
Figure 6:
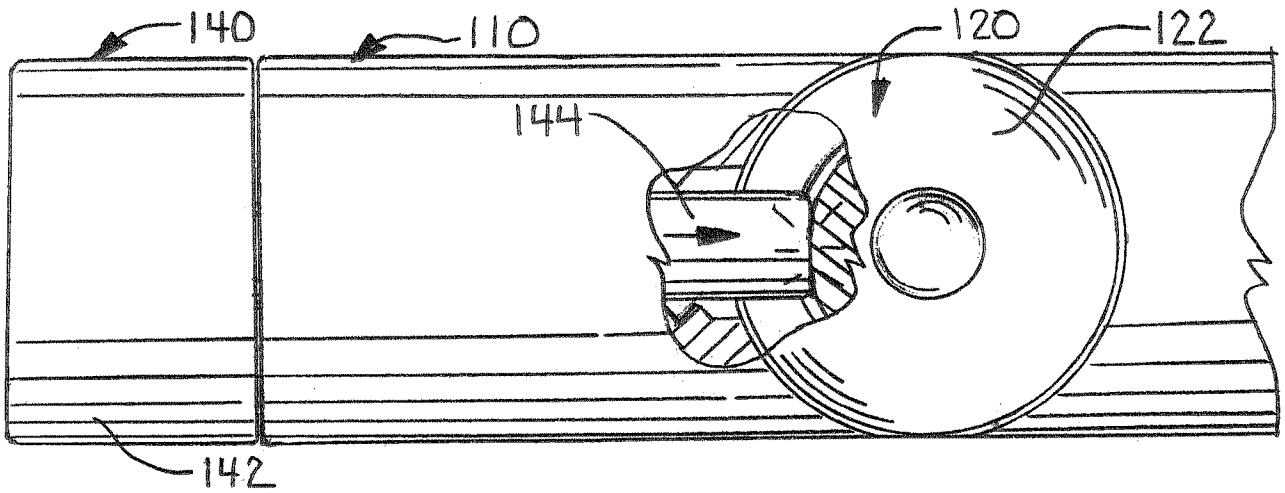
FIG. 6 is a top view of the cleaning rod handle of FIG. 1 shown in the locked position with portions cut away.
Figure 7:
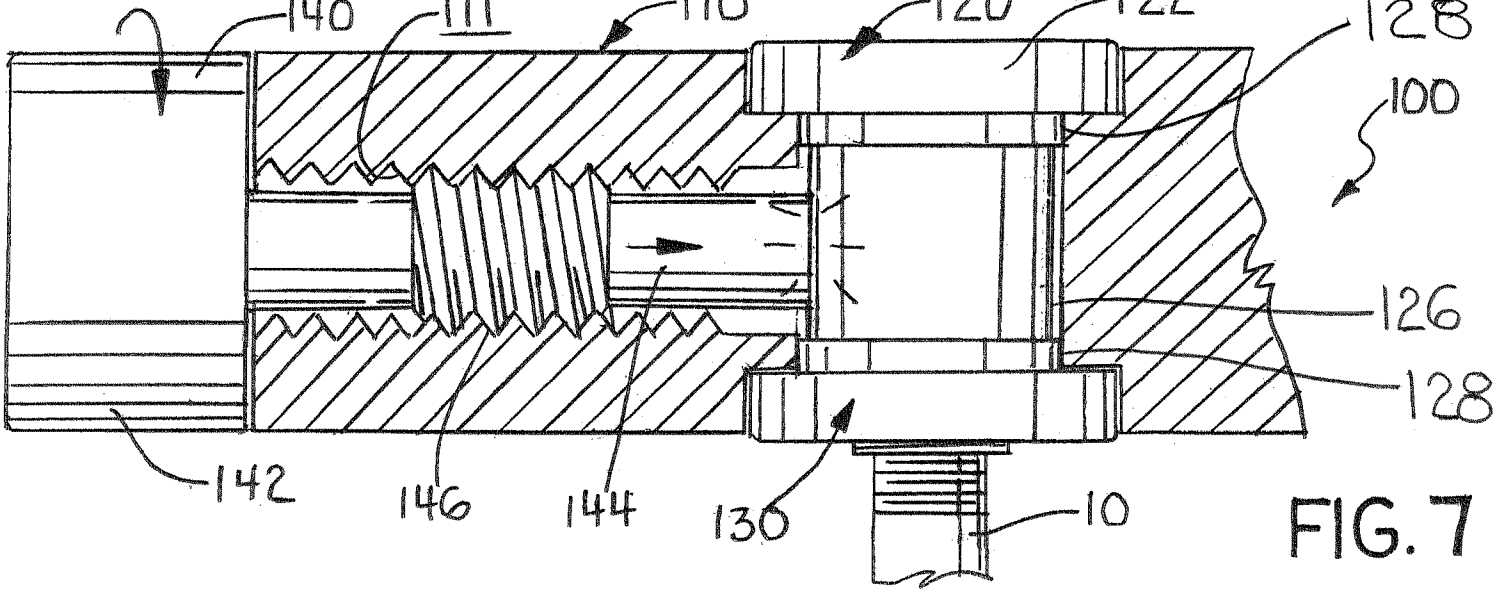
FIG. 7 is a partial side sectional view of the cleaning rod handle of FIG. 1 shown in the locked position.
Figure 8:
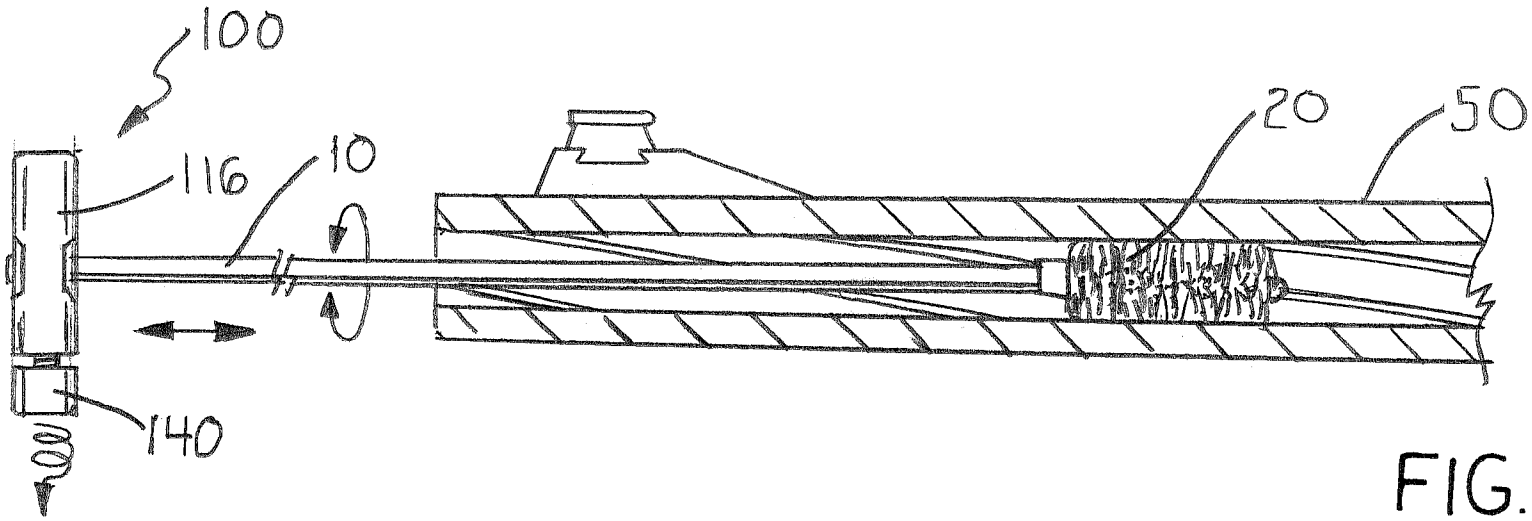
FIG. 8 is a partial side sectional view of the cleaning rod handle of FIG. 1 shown in use in the unlocked position with a firearm barrel.

Locking member 140 is turned into threaded axial bore 111 of handle body 110. Locking member 140 includes a flat annular head 142 and an elongated shaft 144 that extends into threaded bore 111. Head 142 is shaped and dimensioned to conform to the cylindrical shape and dimensions of handle body 110. Shaft 144 has an externally threaded section 146 that mates with the internal threads of bore 111. As shown in FIGS. 4-7, locking member 140 is manually turned into handle body 110 to either restrictively engage barrel coupler 120 in a "locked" position" (FIGS. 6, 7 and 9) or be spaced from barrel coupler 120 in an "unlocked" position (FIGS. 4, 5 and 8). In the locked position, the end of shaft 142 abuts against the cylindrical body of barrel coupler 120, which prevents the barrel coupler from rotating within handle body 110. In the unlocked position, the end of shaft 142 is spaced from the barrel coupler, which is allowed to rotate freely within handle body 110.

Figure 9:
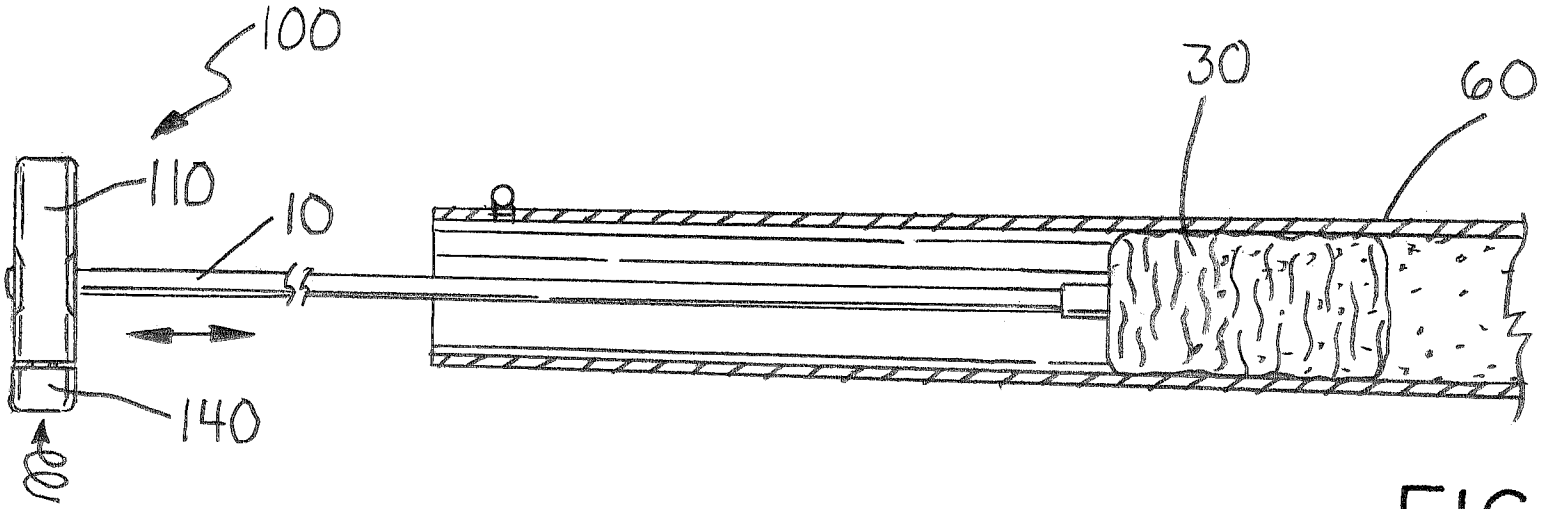
FIG. 9 is a partial side sectional view of the cleaning rod handle of FIG. 1 shown in use in the unlocked position with a firearm barrel.

FIGS. 8 and 9 illustrate handle 100 in use cleaning firearm barrels. In both figures, handle 100 is affixed to a conventional rod section 10 with an attached cleaning brush 20 or swab 30 and used in a conventional manner grasping handle 100 to reciprocate rod section 10 passing brush 20 or swab 30 back and forth through the barrel of the firearm. A user can manually tighten or loosen locking member 140 to quickly place handle 100 in either the locked or unlocked positions. FIG. 8 illustrates handle 100 used with a rifled bore barrel 50 in an unlocked position. Locking member 140 is not fully tightened down against barrel coupler 120, which allows barrel coupler 120 and rod section 10 to rotate freely as brush is drawn back and forth through rifled barrel 50. FIG. 9 illustrates handle 100 used with a smooth bore barrel 60 in a locked position. Locking member 140 is manually tightened down against barrel coupler 120, which prevents barrel coupler 140 and rod section 10 from rotating as swab 30 is drawn back and forth through smooth bore barrel 60.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A handle for a firearm cleaning rod comprising:

a handle body;

a barrel coupler mounted to the handle body to rotate relative to the handle body and adapted for connection to the cleaning rod, the barrel coupler has a bore extending axially through the barrel body and internally threaded to receive the cleaning rod;

a barrel retainer connected to the barrel coupler to secure the barrel coupler to the handle body; and a locking member mounted to the handle body to be movable between a locked position where the locking member restrictively abuts the barrel coupler, thereby preventing the rotation of the barrel coupler relative to the handle body, and an unlocked position where the locking member is spaced from the barrel coupler, thereby allowing the rotation of the barrel coupler relative to the handle body.

2. The handle of claim 1 wherein the barrel coupler has a cylindrical barrel body terminating in an annular head and a threaded neck at opposite ends thereof.

3. The handle of claim 2 wherein the barrel retainer is affixed to the neck of barrel coupler.

4. The handle of claim 1 wherein the handle body has a first opening extending through the handle body and a second opening extending into the first opening, the barrel coupler rotatably disposed within the first opening, the locking member shiftably disposed within the second opening.

5. The handle of claim 4 wherein the barrel coupler has a cylindrical barrel body centered within the first opening at the end of the second opening.

6. The handle of claim 4 wherein the locking member includes a head part and an elongated shaft, the shaft disposed within the second opening, the head part extending from the handle body.

7. The handle of claim 4 wherein the handle body is cylindrical having opposed ends thereof, the first opening extends laterally through the handle body between the opposed ends, the second opening extends axially from one of the opposed ends.

8. A handle for a firearm cleaning rod comprising:

an elongated handle body having opposed ends thereof, the handle body also having a first opening extending laterally through the handle body and a second opening extending axially from one of the handle body ends into the first opening;

a barrel coupler disposed within the first opening of the handle body to rotate relative to the handle body, the barrel coupler has a cylindrical barrel body terminating in an annular head and a threaded neck at opposite ends thereof, the barrel coupler has a bore extending axially through the barrel body and internally threaded to receive the cleaning rod;

a barrel retainer affixed to the threaded neck of the barrel coupler to secure the barrel coupler to the handle body; and a locking member mounted to the handle body to be movable between a locked position where the locking member restrictively abuts the barrel coupler, thereby preventing the rotation of the barrel coupler relative to the handle body, and an unlocked position where the locking member is spaced from the barrel coupler, thereby allowing the rotation of the barrel coupler relative to the handle body, the locking member includes a head part and an elongated shaft, the shaft disposed within the second opening, the head part extending from the handle body.

9. A handle for a firearm cleaning rod comprising:

a handle body;

a barrel coupler mounted to the handle body to rotate relative to the handle body and adapted for connection to the cleaning rod, the barrel coupler has a cylindrical barrel body terminating in an annular head and a threaded neck at opposite ends thereof;

a barrel retainer connected to the barrel coupler to secure the barrel coupler to the handle body; and a locking member mounted to the handle body to be movable between a locked position where the locking member restrictively abuts the barrel coupler, thereby preventing the rotation of the barrel coupler relative to the handle body, and an unlocked position where the locking member is spaced from the barrel coupler, thereby allowing the rotation of the barrel coupler relative to the handle body.

10. The handle of claim 9 wherein the barrel coupler has a bore extending axially through the barrel body and internally threaded to receive the cleaning rod.

11. The handle of claim 10 wherein the barrel retainer is affixed to the neck of barrel coupler.

12. The handle of claim 9 wherein the handle body has a first opening extending through the handle body and a second opening extending into the first opening, the barrel coupler rotatably disposed within the first opening, the locking member shiftably disposed within the second opening.

13. The handle of claim 12 wherein the barrel coupler has a cylindrical barrel body centered within the first opening at the end of the second opening.

14. The handle of claim 12 wherein the locking member includes a head part and an elongated shaft, the shaft disposed within the second opening, the head part extending from the handle body.

15. The handle of claim 12 wherein the handle body is cylindrical having opposed ends thereof, the first opening extends laterally through the handle body between the opposed ends, the second opening extends axially from one of the opposed ends.

* * * * *